US008382615B2

(12) United States Patent
Carsey

(10) Patent No.: US 8,382,615 B2
(45) Date of Patent: Feb. 26, 2013

(54) GOLF TURF REPAIR DEVICE

(76) Inventor: Kevin R. Carsey, Garden City, NY (US)

( * ) Notice: Subject to any disclaimer, the term of this patent is extended or adjusted under 35 U.S.C. 154(b) by 132 days.

(21) Appl. No.: 13/134,063

(22) Filed: May 27, 2011

(65) Prior Publication Data

US 2011/0230281 A1 Sep. 22, 2011

Related U.S. Application Data

(63) Continuation-in-part of application No. 12/583,231, filed on Aug. 17, 2009, now abandoned.

(51) Int. Cl.
*A63B 57/00* (2006.01)

(52) U.S. Cl. ..... 473/408

(58) Field of Classification Search ..... 473/408, 473/406, 285, 286, 387; 224/918; D21/793, D21/794, 796

See application file for complete search history.

(56) References Cited

U.S. PATENT DOCUMENTS

| | | | | | |
|---|---|---|---|---|---|
| 3,298,579 | A * | 1/1967 | Smith | 224/918 |
| 3,870,300 | A * | 3/1975 | Amendola | 473/391 |
| 4,960,239 | A * | 10/1990 | Wait | 473/408 |
| 5,643,113 | A * | 7/1997 | Rodgers | 473/408 |
| D412,958 | S * | 8/1999 | Sisson | D21/796 |
| 6,095,934 | A * | 8/2000 | Ohama | 473/408 |
| D489,112 | S * | 4/2004 | Jacome | D21/796 |
| D494,244 | S * | 8/2004 | Jacome | D21/793 |
| 6,872,155 | B2 * | 3/2005 | Jacome | 473/386 |
| 2002/0187861 | A1 * | 12/2002 | Jacome | 473/408 |
| 2007/0202967 | A9 * | 8/2007 | Blanks | 473/408 |
| 2011/0039639 | A1 * | 2/2011 | Carsey | 473/408 |

* cited by examiner

*Primary Examiner* — Steven Wong

(57) ABSTRACT

A golf device is provided for turf repair and holding golf tees and a ball marker. The device utilizes the golf tees themselves to do turf repair and firmly holds the tees in place during the repair function. The device includes a body having a cap section and base section which are slidable held together so that the cap section is positioned immediately atop the base section to hold golf tees in place and prevent them from sliding upward during repair. Inserts are provided to magnetically attract the cap section to the base section and to removably hold a ball marker.

11 Claims, 3 Drawing Sheets

GOLF TURF REPAIR DEVICE

This application is a continuation-in-part of U.S. patent application Ser. No. 12/583,231, filed Aug. 17, 2009 now abandoned, and is related to the design application of same name filed contemporaneously herewith.

BACKGROUND OF THE INVENTION

1. Field of the Invention

This invention relates to a device for the game of golf, and more particularly to a device that provides a golf repair function using golf tees and which also carries a ball marker.

2. Description of Related Art

Golf is a game requiring a large number of items. The golf clubs themselves are divided into an array of different lengths and types depending upon the shot required. In addition to the clubs, golfers need to carry a number of items such as golf tees and ball markers. The golfer should also carry a tool to repair damage when the golf ball strikes the green. While these items are small enough to carry in the golfer's pockets, it can be difficult to find a particular item when needed, especially if the items are kept in different pockets.

Golf can be a very enjoyable game. One of the charms of golf is that on occasion even an average golfer can make a shot that rivals the top professionals. However, golf is a difficult game that requires a significant amount of concentration. Many problems arise in the course of a round of golf, some of which are presented by the golf course itself, and others arise from the mechanics of the golfer's swing. It is therefore important that the golfer eliminate as many distractions as possible that might disturb his or her concentration on the course. The need for locating a particular item such as tees, a reliable repair device and a ball marker without undue effort would help the golfer retain concentration and be highly desirable.

Many attempts have been made to address the golfer's needs. One such attempt is described in U.S. Pat. No. 4,960,239 which discloses a golf turf repair device. That device has permanent prongs for repairing the turf which can get damaged and render the device useless. Such devices can also get unduly soiled requiring the golfer to repeatedly clean the permanent prongs. U.S. Pat. No. 6,872,155 B2; U.S. Patent application Publication No. 2002/0187861A1 and US D494,244 S disclose devices having pivot arms, screws, hinges, plugs, flaps and push dowels to attempt to hold golf tees in place. Such mechanical mechanisms can become easily broken or open during use. They can also leave gaps in the device, for example around the tops of the golf tees, where turf can enter and require cleaning.

U.S. Pat. No. 4,386,774 discloses a golf repair device having permanent prongs. U.S. Pat. No. 6,422,955 B1 discloses a golf ball marker device, without a golf turf repair function. Other references disclosing golf devices include: U.S. Pat. Nos. 1,955,650; 3,298,579; 3,799,331; 4,151,937; 5,795,248; 5,799,853; 6,095,934; 6,220,973; 2003/0010796A1 and 2007/0149325A1.

Thus, there are many references addressing, or attempting to address, the various problems the golfer faces. Nevertheless, there still exists a need for a sturdy device that can be readily carried and accessed by the golfer to provide golf tees, a ball marker and a turf repair function without the need for mechanical mechanisms such as pegs, hinges, pivot arms, screws, push dowels or overlapping flaps, to attempt to provide a sturdy and readily cleaned device that can securely hold the golf tees in place for turf repair.

Accordingly, one of the objects of the present invention is to provide a sturdy device that has a golf turf repair function. Another object is to provide a device for holding golf tees and a ball marker so that each such item can be easily located by the golfer during a round of golf. Another object of the present invention is to provide a golf repair device, tee holder and ball marker holder that can be economically made, and which has a solid feel and is less subject to opening or breaking. Still another object is provide a device which can hold golf tees in place to provide the repair function without the need for undue cleaning.

SUMMARY OF THE INVENTION

These and other objects of the present invention can be attained by providing a golf device having a body, comprised of a base section and a cap section.

The base section has a sliding plane and an emerging plane and at least two elongated annular channels extending throughout the entire length of the base section and being entirely surrounded by the base section, each of the annular channels having recessed top ends and being sized to receive and removably hold a golf tee therein such that the golf tees are positioned completely beneath the sliding plane of the base section. When the golf tees are held in the base section, the golf tees extend through the emerging plane of the base so that the golf tees are positioned to cooperatively work together to provide a repair function. The device has a rail section extending above the sliding plane of the base section. The rail section has a widening shape in at least a part thereof above the sliding plane. The base section can have a base section insert for magnetic attraction, preferably the base section insert is positioned in the rail section. The device further includes a cap section having an upper level and at least two retainer sections. The cap section has a hollow section beginning at the bottom edge of the cap section of substantially the same shape as the shape of the rail section so that the cap section is adapted to slideably engage the rail section of the base section and be held in registering relation with the base section. The retainer sections of the cap section are situated above the annular channels of the base section to retain golf tees from sliding upward during turf repair to provide a firm turf repair function. The cap section can have a cap section insert for magnetic attraction.

The base section insert and the cap section insert can be magnetically attracted to one another either by being magnets of opposite polarity, or by one being a magnet and the other being a metal attracted to the magnet.

Among the benefits of this invention, is that the body of the device does not unduly engage the soil during turf repair. The cover is securely held directly atop the body, with the golf tee tops entirely within the body so there is no gap between the body and the cover which might otherwise become soiled and require the golfer to dislodge dirt and distract concentration during play. If it is desired to remove excessive soil the golfer can simply pull the golf tees out of the device, and soil can be expunged due to its forced contact with the device. The body is adapted to removably secure and hold the golf tees in place during turf repair, and to magnetically hold a ball marker so that it can be easily located and used. The ball marker can be magnetically attracted to the base section insert, the cap section insert, or both. The ball marker can either be a magnet of opposite polarity to the cap section insert magnet or the base section insert magnet, or it can be made in whole a in part of a metal capable of attraction to a the base section insert magnet or the cap section insert magnet. Alternatively, the device can hold a ball marker by providing a marker having an outward protrusion and a recess in either the cap section or body section for removably attaching the ball marker via a friction fit. The overall design of the golf device is quite sturdy and solid, and less susceptible to breaking.

DESCRIPTION OF THE INVENTION

The invention described herein comprises a body (10) having a base section (12) and a cap section (14). Any of a wide array of commercially available materials can be used to make body (10) in whole or in party, including woods, metals, or plastics, such as thermoplastic polymers or thermosetting polymers. Thermoplastic polymers, such as polyesters, polyamides, and polyurethanes are preferred. The polymers can be glass filled to provide additional rigidity. Glass filled polyamide nylon 6-6, is particularly preferred for use in body (10).

Figure 1:
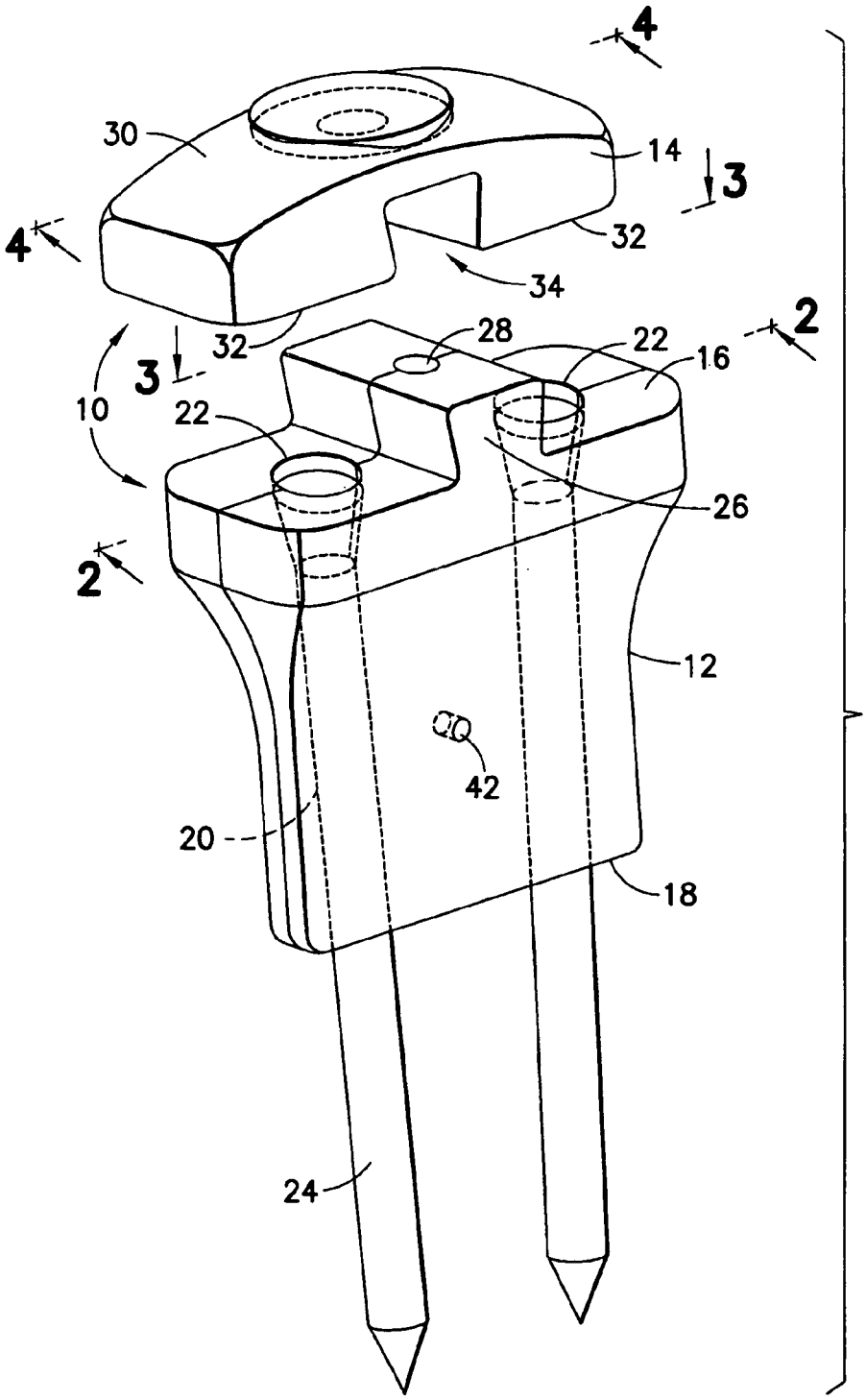
FIG. 1 is an isometric view of the golf turf repair device with ball marker of the invention showing the disposition of two golf tees therein, and the cap section slideably removed from atop the base section.
Figure 2:
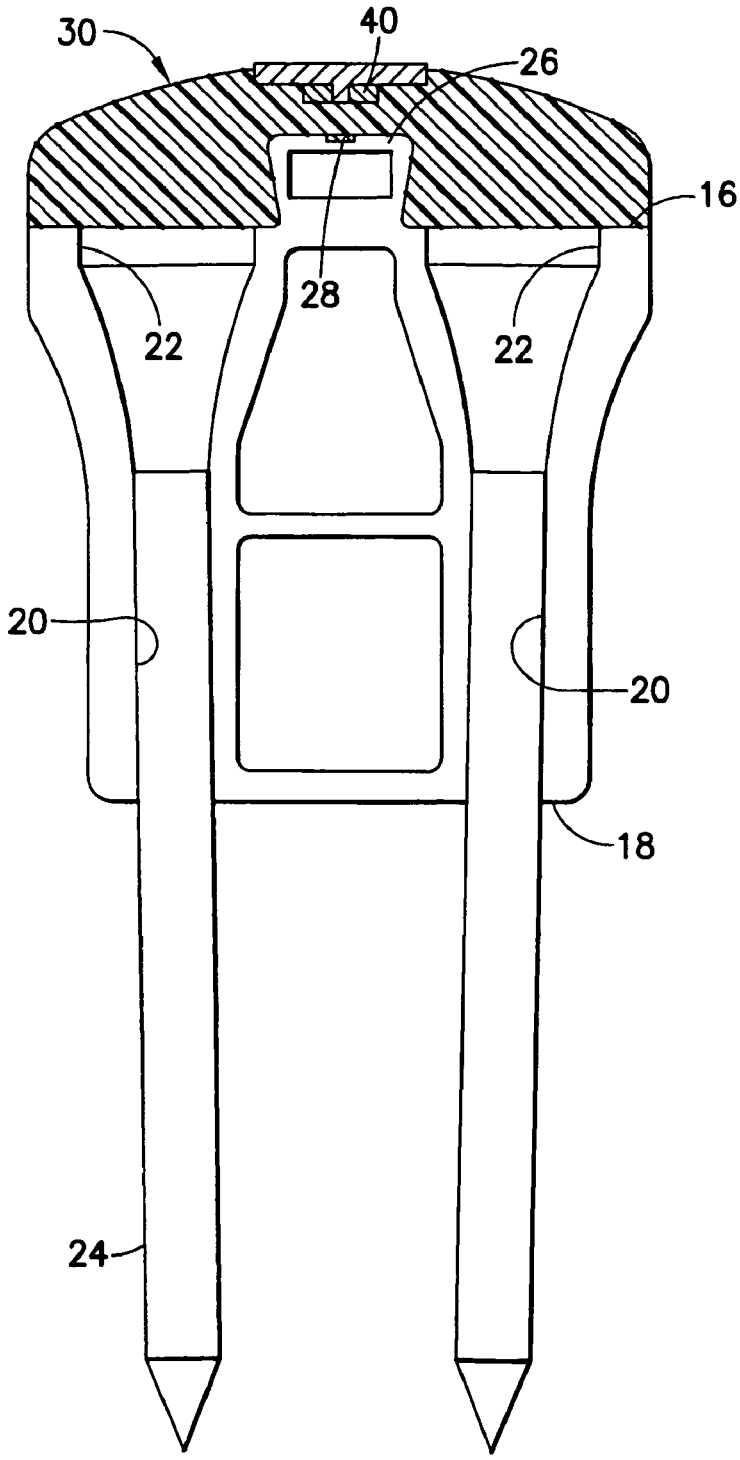
FIG. 2 is a cross sectional side view of the device taken along line 2-2 of FIG. 1.
Figure 3:
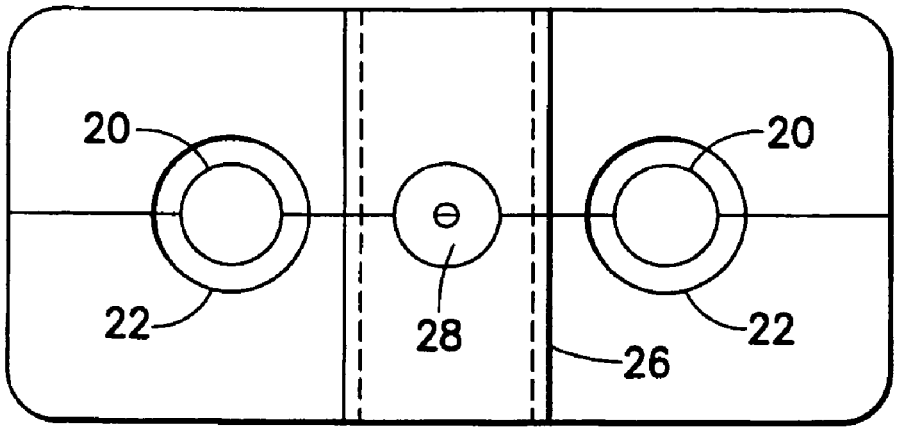
FIG. 3 is a cross sectional top view of the base section taken along line 3-3 of FIG. 1.
Figure 4:
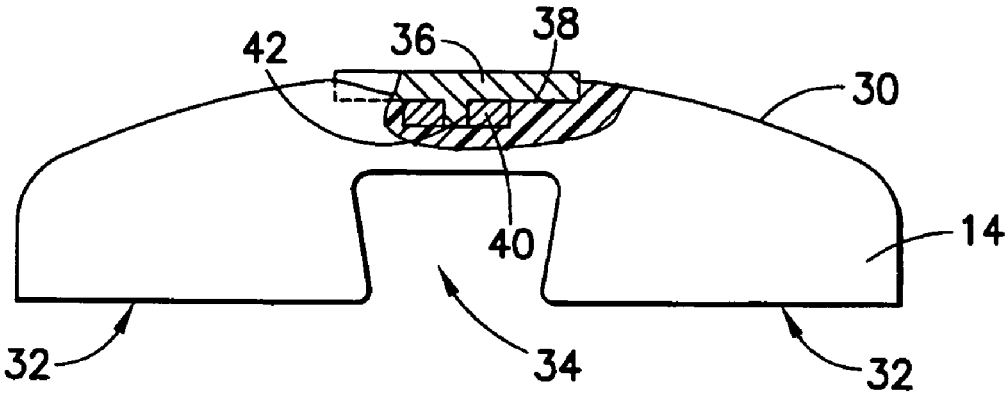
FIG. 4 is side view of the cap section taken along line 4-4 of FIG. 1.

As shown in FIG. 1, the base section has a sliding plane (16), an emerging plane (18) and at least two elongated annular channels (20) extending throughout the entire length of the base section (12). Annular channels (20) can be formed by boring through the base section (12) from sliding plane (16) to bottom plane (18). Alternatively, the base section (12) can be made in two mirror image halves wherein half of the annular channels are in a surface of each half of base section, and are joined together, e.g., with and adhesive such as an epoxy resin, so that when the two halves of base section (12) are joined, full annular channels (20) are formed which are entirely surrounded by the base section (12). The annular channels (20) can each have recessed top ends which are sized, together with annular channels (20) themselves, to receive and removably hold golf tees (24) therein. Golf tees (24) are positioned completely beneath the sliding plane (16) of base section (12) so that when the golf tees (24) are held in the base section (12) they can extend through the entire length of the base section (12) and through the emerging plane (18) of the base section (12) and be entirely below the sliding plane. In this manner, the golf tees (24) are positioned to cooperatively work together to provide a turf repair function. The annular channels (20) can be parallel, or they can be tapered, such as toward each other.

Base section (12) is provided with a rail section (26) which is above the sliding plane (16) of base section (12) for receiving cap section (14) as discussed below.

Rail section (26) can have a wide array of shapes. However, it is preferred that rail section (26) have a widening shape in at least a part thereof above the sliding plane. In this way, the rail section will have a wider cross sectional area at a point above sliding plane (16) than the cross sectional area of the rail sections nearer to or at the sliding plane (16) itself so that the rail section (26) can act to securely hold and directly contact cap section (14) immediately atop base section (12) utilizing a correspondingly shaped hollow section (34) in cap section (12). Rail section (26) of body section (12) and hollow section (34) of cap section (14) each have the same shape which can be any of a wide variety of shapes, such as spherical or triangular. Preferably rail section (26) and hollow section (34) are both trapezoidal in shape.

The base section (26) can be provided with a base section insert (28) for magnetic attraction, comprised of magnetic material, such as a ferromagnet or a ferrimagnet. Preferably, base section insert (28) is positioned in rail section (26).

The cap section (14) has an upper level (30) and at least two retainer sections (32). The cap section (14) is preferably made of the same material as the base section (12) of the body (10), preferably, glass filled nylon 6-6.

The cap section (14) has a hollow section (34) beginning at the bottom edge which, as indicted above, is adapted to slideably receive rail section (26) of bottom section (12). Since hollow section (34), has substantially the same shape as rail section (26), and golf tees (24) are positioned below sliding plane (16), the cap section (14) is adapted to slideably engage the rail section (26) of base section (12) and be held in registering relation with base section (12). Advantageously, the retainer sections (32) of cap section (14), are thereby situated above the annular channels (20) of base section (12). A device is thus provided that can firmly hold golf tees (24) in place so that during use golf tees (24) do not slide upward and instead are firmly held in place in body (10) to provide a firm repair function, with the cap section (14) being immediately atop base section (12). It will be seen that a device is provided that does not require permanent prongs to accomplish turf repair, or the need for undue mechanical mechanisms.

Cap section (14) can have a cap section insert (40) for holding cap section (14) to base section (12) by magnetic attraction. Base section insert (28) and cap section insert (40) are magnetically attracted to one another either by being magnets of opposite polarity, or by one being a magnet and the other being in whole or in part a metal such as iron or steel capable of attraction to the magnet. Thus, when cap section insert (40) is metal, base section insert (28) can be a magnet. When cap section insert (40) is a magnet, base section insert (28) can either be a magnet of opposite polarity or a metal capable of attraction to the magnet.

A ball marker (36) is provided for marking the golfer's ball on the green. Ball marker (36) can be magnetically attracted to either the cap section insert (40), the base section (28) insert, or both. Ball marker (36) can either be a magnet or contain a magnet in whole or in part of opposite polarity to the cap section insert magnet or the base section insert magnet, or ball maker (36) can be made in whole or in part of a metal capable of attraction to a magnet in the cap section insert magnet or the base section insert magnet, or both.

The shape of the body can be tapered and have rounded sides to provide a streamline device to give the golfer a confident and secure feel, as well as provide ready accessibility to golf tees and a ball marker needed to play golf. The preferred embodiment of the device comprises two annular channels (20), for holding and carrying two golf tees (24), with the body section (12) made of plastic such as glass filled Nylon 6-6, and have at least one metal ball marker (36) adapted to be magnetically held and removably attached to the of cap section insert magnet (40), preferably at upper level (30), or it can be held at the sides of base section (12) via a base section insert magnet (28), or both. Recesses can be also provided in the cap section (14) such as in the upper level (30), or along the sides of the base section (12) so that the ball marker (36) can more securely fit to the body and be partially imbedded therein.

Figure 5:
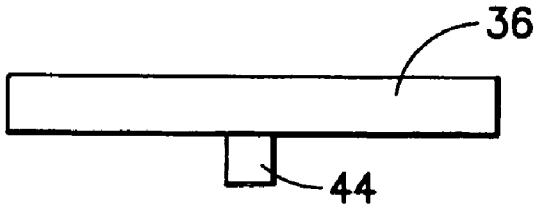
FIG. 5 is a view of a ball marker having an outward protrusion.

Preferably, ball marker (36) is metal, cap section insert (40) is a magnet, and base section insert (28) is located in the rail section (26) and is either a metal or a magnet having the opposite polarity as the magnet in cap section insert magnet (40). In this manner, a golf device is provided which can magnetically secure and slideably hold the cap section (14) immediately atop base section (12) and hold a golf marker as well, all while firmly holding golf tees in place. This can enable the golfer to conveniently carry a turf repair device and ball markers without having to search through separate pockets, or inconveniently snap items in place. As another alternative, the ball marker and body can each be configured to permit the marker to be removably attached, e.g., via a friction fit wherein the ball marker (36), can have a protrusion (44) as shown in FIG. 5 and either cap section (14) or body section (12), or both, can have a recess (42) for receiving the protrusion (44) of ball marker (36).

Proper golf etiquette dictates that a golfer repair damage to the putting surface, especially damage that occurs when the golf ball strikes the green. When the device is loaded with two golf tees, the golf tees extend beyond the emerging plane (18) of base section (12) and the end of the golf tees can be used to repair the turf putting surface.

The device of the invention secures golf tees (24) in place during turf repair and prevents the tees from sliding during repair. The device can be made in any of a large number of ways. For example, the device can be made by casting, or by plastic injection molding techniques.

Although the present invention has been described with reference to preferred embodiments thereof, many modifications and alterations can be made within the context of the present invention.

The invention claimed is:

1. A golf device comprising:

a body, having a base section and a cap section;

said base section having a sliding plane and an emerging plane and at least two elongated annular channels extending throughout the entire length of said base section and being entirely surrounded by said base section, each of said annular channels having recessed top ends and being sized to receive and removably hold a golf tee therein such that said golf tees are positioned beneath said sliding plane of said base section and extend through the emerging plane of said base section so that said golf tees are positioned to cooperatively work together to provide a repair function;

said base section further having a rail section extending above said sliding plane of said base section;

said rail section having a widening shape in at least a part thereof above said sliding plane;

said base section having a base section insert for magnetic attraction;

said cap section having an upper level and at least two retainer sections;

said cap section having a hollow section beginning at a bottom edge of said cap section of substantially the same shape as the shape of said rail section so that said cap section is adapted to slideably engage said rail section of said base section and be held in registering relation with said base section, with said retainer sections of said cap section situated above said annular channels of said base section;

said cap section having a cap section insert for magnetic attraction;

said base section insert and said cap section insert being magnetically attracted to one another by either being magnets of opposite polarity, or by one being a magnet and the other being a metal attracted to said magnet;

a ball marker comprised of a material capable of being magnetically attracted to either the base section insert or said cap section insert, or both.

2. The golf device of claim one wherein said rail section of said base section and said hollow section of said cap section each have a trapezoidal shape.

3. The golf device of claim 1, wherein a recess of substantially the same shape as said ball marker is provided in said cap section or said body section to partially embed said ball marker in said body.

4. The golf device of claim 1 wherein said annular channels are tapered toward each other.

5. The golf device of claim 1, wherein said cap section and said body section are comprised of a glass filled nylon 6-6 composition in whole or in part.

6. The golf device of claim 1 wherein said base section insert is a magnet and said ball marker and said cap section inserts are comprised in whole in part of a metal capable of magnetic attraction to said base section insert.

7. The golf device of claim 1 wherein said base section insert and said cap section inserts are magnets of opposite polarity and said ball marker is comprised in whole or in part of a metal capable of attraction to either said base section insert, said cap section insert, or both.

8. A golf device comprising:

a body, having a base section and a cap section;

said base section having a sliding plane and an emerging plane and at least two elongated annular channels extending throughout the entire length of said base section and being entirely surrounded by said base section, each of said annular channels having recessed top ends and being sized to receive and removably hold a golf tee therein such that said golf tees are positioned beneath said sliding plane of said base section and extend through the bottom plane of said base section so that said golf tees are positioned to cooperatively work together to provide a repair function;

said base section further having a rail section extending above said sliding plane of said base section;

said rail section having a widening shape in at least part thereof above said sliding plane;

said cap section having an upper level and at least two retainer sections;

said cap section having a hollow section beginning at a bottom edge of said cap section of substantially the same shape as the shape of said rail section so that said cap section is adapted to slideably engage said rail section and be held in registering relation with said base section, with said retainer sections of said cap section situated above said annular channels of said base section;

a recess positioned in said base section or said cap section, or both, a ball marker having a protrusion therefrom adapted to removably attach to said recess in either said cap section or said base section, or both, via a friction fit.

9. The golf device of claim 6 wherein said rail section of said base section and said hollow section of said cap section each have a trapezoidal shape.

10. The golf device of claim 6 wherein said body section and said cap section are comprised in whole or in part of wood, metal, plastic or a combination thereof.

11. The golf device of claim 6 wherein said body section and said cap section are both comprised of a glass filled nylon 6-6 composition.

* * * * *